US007097086B2

(12) United States Patent
Joyce et al.

(10) Patent No.: US 7,097,086 B2
(45) Date of Patent: Aug. 29, 2006

(54) STAPLER WITH LEAF SPRING ACTUATION MECHANISM

(75) Inventors: Michael P. Joyce, 801 W. Shore Dr., Kinnelon, NJ (US) 07405; Brent Lucas, Leonardo, NJ (US)

(73) Assignee: Michael P. Joyce

( * ) Notice: Subject to any disclaimer, the term of this patent is extended or adjusted under 35 U.S.C. 154(b) by 0 days.

(21) Appl. No.: 11/009,369

(22) Filed: Dec. 10, 2004

(65) Prior Publication Data

US 2006/0124685 A1 Jun. 15, 2006

(51) Int. Cl.
*B25C 5/10* (2006.01)
*B25C 5/16* (2006.01)

(52) U.S. Cl. ..... 227/120; 227/132

(58) Field of Classification Search ..... 227/120, 227/132, 130
See application file for complete search history.

(56) References Cited

U.S. PATENT DOCUMENTS

| | | | | |
|---|---|---|---|---|
| 3,593,904 | A | 7/1971 | Gaya | |
| 3,630,428 | A | 12/1971 | Olney | |
| 3,958,738 | A | 5/1976 | Tremblay | |
| 4,182,474 | A | 1/1980 | Sato | |
| 4,288,019 | A | 9/1981 | Dahle | |
| 4,399,938 | A | 8/1983 | Biddle | |
| 4,452,388 | A | 6/1984 | Fealey | |
| 4,463,890 | A | 8/1984 | Ruskin | |
| 5,165,587 | A | 11/1992 | Marks | |
| 5,335,838 | A | 8/1994 | Harris et al. | |
| 5,335,839 | A * | 8/1994 | Fealey | 227/132 |
| 5,356,063 | A | 10/1994 | Perez | |
| 5,407,118 | A | 4/1995 | Marks | |
| 5,497,932 | A | 3/1996 | Brewer et al. | |
| 5,511,716 | A | 4/1996 | Marks | |
| 5,664,722 | A | 9/1997 | Marks | |
| 5,699,949 | A | 12/1997 | Marks | |
| 5,816,470 | A | 10/1998 | Plato et al. | |
| 5,979,736 | A | 11/1999 | Edehot | |
| 5,988,478 | A | 11/1999 | Marks | |
| 6,145,728 | A | 11/2000 | Marks | |
| 6,789,719 | B1 | 9/2004 | Shor | |
| 6,918,525 | B1 | 7/2005 | Marks | |

OTHER PUBLICATIONS

Int'l Search Rept & Written Opinion, Mar. 2, 2006, Joyce.

* cited by examiner

*Primary Examiner*—Scott A. Smith
*Assistant Examiner*—Gloria R. Weeks
(74) *Attorney, Agent, or Firm*—Kaplan Gilman Gibson & Dernier LLP

(57) ABSTRACT

The present invention provides a stapler with a novel leaf spring actuation mechanism. According to the teaching of the present invention, the stapler comprises a striking plate for dispensing a staple from a staple magazine, a leaf spring engaged with the striking plate for driving the striking plate, and an actuation bar for lifting the leaf spring from a first position to a second position whereby lifting the striking plate from an initial position to a release position in which the leaf spring is released from the actuation bar to drive the striking plate towards the initial position. Preferably, a pair of lugs on the actuation bar pushes up a pair of tabs on the leaf spring when an L-shaped front end of the actuation bar moves upward along a ramp when an external force is applied to the actuation bar during the stapling operation.

28 Claims, 6 Drawing Sheets

STAPLER WITH LEAF SPRING ACTUATION MECHANISM

FIELD OF THE INVENTION

The present invention relates to a stapling apparatus, and more particularly, to a spring actuated stapler with a simple leaf spring actuation mechanism.

BACKGROUND OF THE INVENTION

In a spring-actuated stapler, when an external force is applied to the stapler (usually by pressing a cover of the stapler), a spring element is loaded, and at the same time a striking plate is moved from an initial position to a release position. When the striking plate arrives at the release position, the spring element is unloaded to powerfully drive the striking plate from the release position back to the initial position to individually dispense a staple from a staple magazine.

There are numerous spring actuation mechanisms to carry out the above operations, however, efforts have never stopped in designing better ones with improvement in simplicity, preciseness and reliability.

SUMMARY OF THE INVENTION

The present invention provides a stapler with a novel leaf spring actuation mechanism. According to the teaching of the present invention, the stapler comprises a striking plate for dispensing a staple from a staple magazine, a leaf spring engaged with the striking plate for driving said striking plate, and an actuation bar for lifting the leaf spring from a first position to a second position whereby lifting the striking plate from an initial position to a release position in which the leaf spring is released from the actuation bar to powerfully drive the striking plate towards the initial position.

In a preferred embodiment, the actuation bar comprises a laterally protruding lug which is adapted to push upward a tab provided on the leaf spring so as to lift the leaf spring when an external force is applied to the actuation bar.

Preferably, the tab disengages itself from the lug when the leaf spring reaches the second position where the striking plate is lifted to the release position.

Preferably, the actuation bar has a front end movable along a guiding ramp when the external force is applied to the actuation bar, thus improving reliability and accuracy of the engagement between the lug of the actuation bar and the tab of the leaf spring.

Preferably, the engagement between the tab and the lug is such that the tab slides on an upper surface of the lug towards an edge of the lug when the front end of the actuation bar moves along the guiding ramp, and drops from the edge of the lug when the leaf spring reaches the second position, whereby releasing the leaf spring from the actuation bar.

BRIEF EXPLANATION OF THE DRAWINGS

The above and other features and advantages of the present invention can be understood better after reading the following detailed description of the preferred embodiment of the present invention with reference to the accompanying drawings, in which.

DETAILED DESCRIPTION OF THE PREFERRED EMBODIMENTS

Figure 1A:
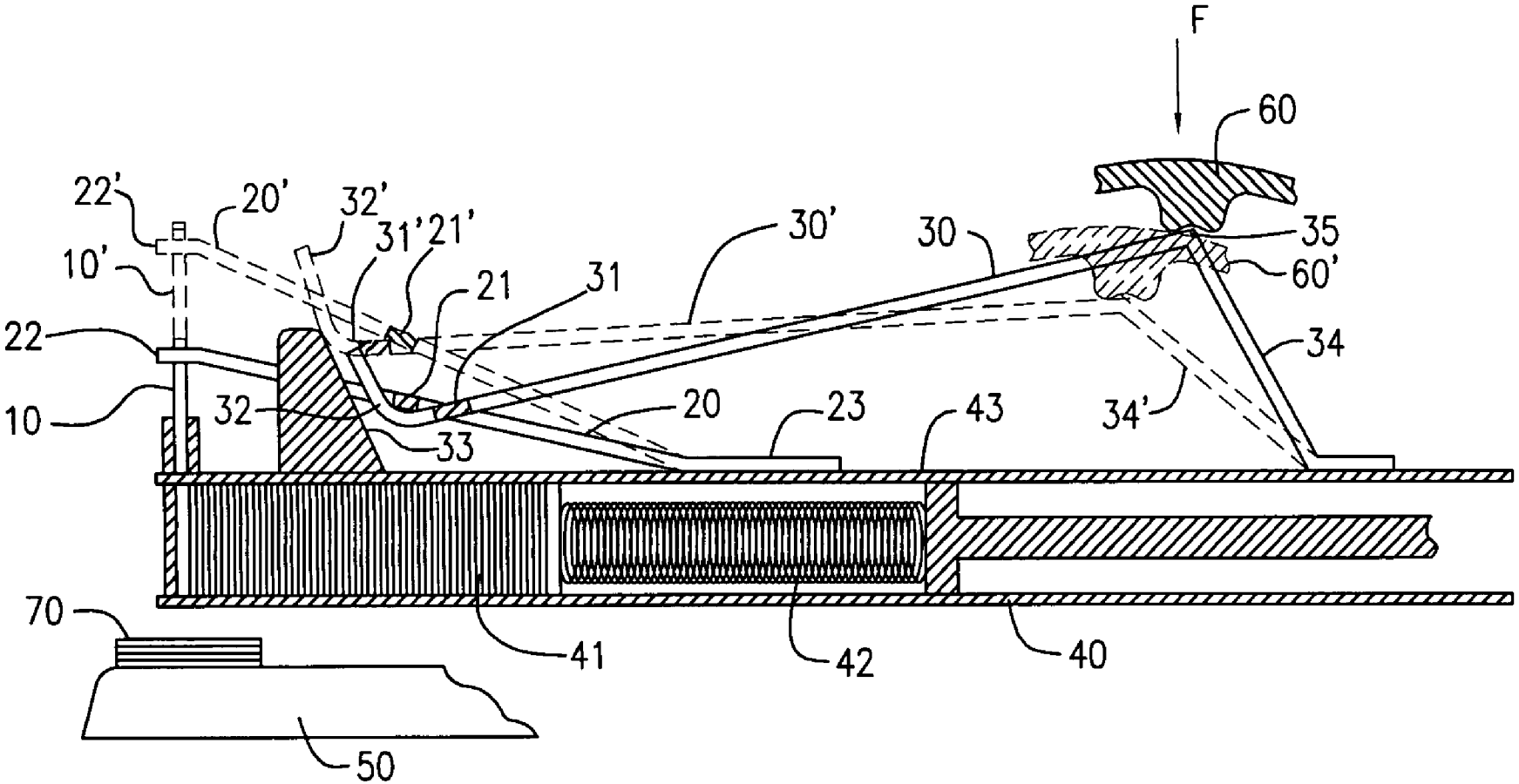
FIG. 1*a* schematically and partially illustrates a preferred embodiment of the stapler according to the present invention.

Similar to a conventional stapler, the stapler according to the present invention mainly comprises a magazine 40 for accommodating a staple stick 41, a base 50 for placing a work piece 70 (such as a stack of paper) thereon, and a cover 60 for accepting a pressing force from a user for a stapling operation, as illustrated in FIG. 1. During a stapling operation, the striking plate 10 is first lifted from an initial position to a release position (as shown in dashed line), leaving a slot space below into which a single staple is pushed from the staple stick 41 under a biasing force from the compressed spring 42. When the striking plate 10 is driven from the release position back to its initial position, the single staple is driven into the work piece 70 on the base 50 to staple the work piece 70.

The improvement of the present invention is generally in the mechanism for actuating the striking plate 10 during the stapling operation, as will be described in detail below.

As schematically illustrated in FIG. 1*a*, the actuation mechanism of the preferred embodiment of the present invention mainly comprises a leaf spring 20 for driving the striking plate 10 between the initial position and the release position, and an actuation bar 30 for lifting the leaf spring 20 from a lower position to an upper position (as shown in dashed lines) so as to lift the striking plate 10 from the initial position to the release position. As will explained in more detail below, when the leaf spring 20 reaches the upper position and therefore the striking plate 10 is brought to the release position, the leaf spring 20 is released from the actuation bar 30, and powerfully drives the striking plate 10 from the release position back to the initial position when the leaf spring returns from the upper position back to the lower position.

A front end 22 of the leaf spring 20 engages with the striking plate 10 (e.g., by a hole in the striking plate 10) so that the front end 22 of the leaf spring 20 moves together with the striking plate 10, whereby driving the striking plate 10 to move vertically between the initial position and the release position. A back end 23 of the leaf spring 20 is fixed to the magazine 40, for example, on an upper surface 43 of the housing body of the magazine 40.

When there is no external force applied to actuation bar 30, the actuation bar 30 is in an idle position, the leaf spring 20 remains in the lower position and the striking plate 10 rests in the initial position, as shown by the solid lines. During the stapling operation, the leaf spring 20 is lifted from the lower position to the upper position and brings the striking plate 10 from the initial position to the release position. At the same time, the leaf spring 20 is loaded when it is lifted upwards.

In the stapling operation, an external force ("F" in FIG. 1*a*) is applied to the actuation bar 30, e.g., by pressing on the cover 60. Under the external force, the actuation bar 30 comes into engagement with the leaf spring 20 and lifts the leaf spring 20 from the lower position to the upper position, whereby bringing the striking plate 10 from the initial position to the release position, as described above.

In the preferred embodiment illustrated in FIG. 1*a*, the actuation bar 30 has a rounded L-shaped front end 32. In the idle position, the L-shaped front end 32 is slightly apart from a ramp 33 formed on the upper surface 43 of the magazine 40. When the external force is applied to the actuation bar 30, the front end 32 is pushed forward to abut against the ramp 33 and moves upward along the ramp 33.

A pair of lugs 31 are provided on the actuation bar 30 (as best shown in FIGS. 2*a*–2*d*), which protrude laterally from the length of the actuation bar 30. When the L-shaped front end 32 is pushed forward by the external force applied to the actuation bar 30, the lugs 31 come into contact with a pair of tabs 21 (best shown in FIGS. 2*a*–2*d*). When the L-shaped front end 32 is pushed, under the external force applied to the actuation bar 30, to moves upward along the ramp 33, the lugs 31 push the tabs 21 upward, whereby lifting the leaf spring 20 toward its upper position as shown in dashed lines, and at the same time loading the leaf spring 20. Consequently, the striking plate 10 is lifted by the front end 22 of the leaf spring 20 to the release position against a biasing force from the leaf spring 20, as shown in dashed lines.

Preferably, when the front end 32 moves upward along the ramp 33, the tabs 21 are able to slide backward along an upper surface of the lugs 31. Thus, the upper surface of the lugs 31 function as a ramp for the tabs 21. In a preferred design, the lugs 31 may assume an angle (e.g., 30 degree) from a main flat body of the actuation bar 30.

When the leaf spring 20 reaches the upper position and therefore the striking plate 10 reaches the release position, the tabs 21 reach back edges 31*a* of lugs 31 and drop from the lugs 31 to disengage themselves from the lugs 31. Under the biasing force loaded in the leaf spring 20, the tabs 21 return to their initial positions (i.e., the lower position shown in solid lines), and the load in the leaf spring 20 is released, which powerfully drives the striking plate 10 from the release position to the initial position where the striking plate 10 strikes a stapler into the work piece 70.

Preferably, a biasing mechanism is provided to the actuation bar 30 so that after the external force applied to the actuation bar 30 is released, the actuation bar 30 can automatically return to its initial position (as shown in solid lines) under a biasing force. In the embodiment shown in FIG. 1*a*, the biasing force is provided by a resilient lever 34 which connects the actuation bar 30 at a back end 35 to the upper surface 43 of the magazine 40. When the actuation bar 30 moves forward under the external force applied to it through the cover 60, the resilient lever 34 is brought to bend forward and the biasing force is loaded in the resilient lever 34. When the external force is removed, the load built in the resilient lever 34 is released, and the resilient lever 34 returns to its initial position and pulls the actuation bar 30 back to its initial position as well.

Figure 1B:
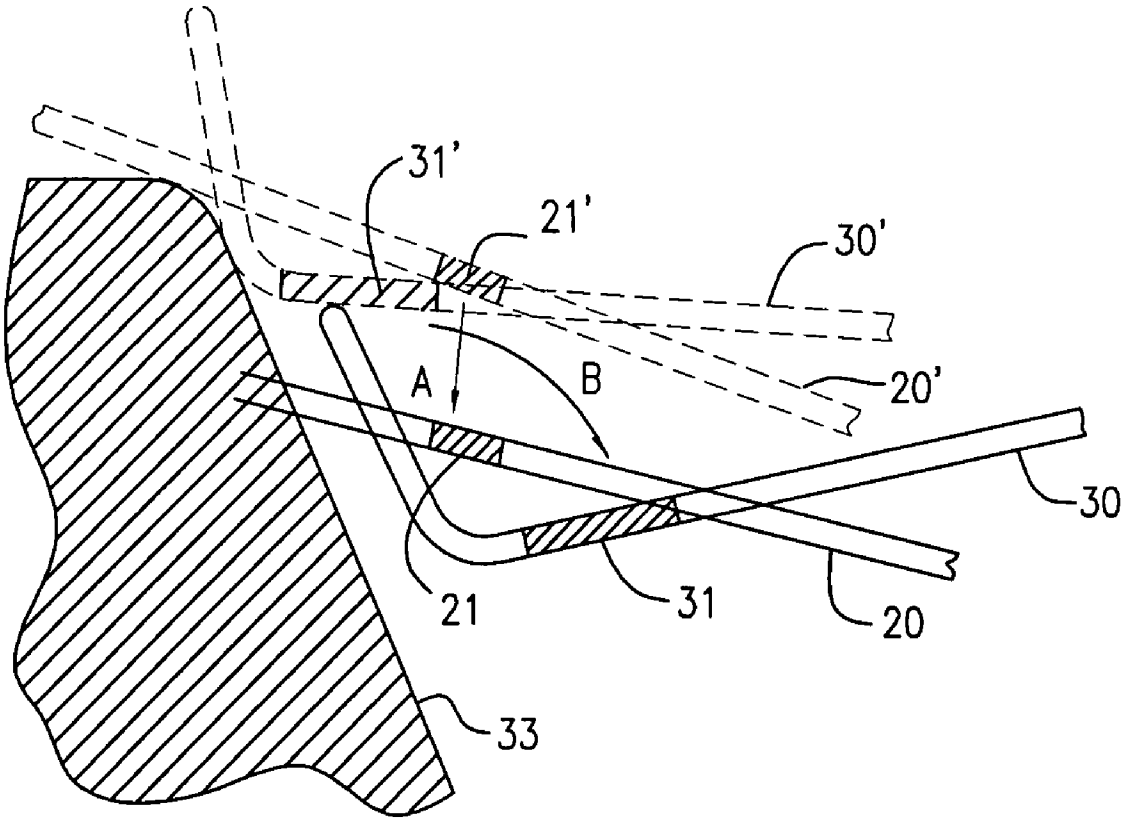
FIG. 1*b* schematically illustrates the paths of the returning movement of the lugs and tabs in FIG. 1*a*.

It is important that the lugs 31 of the actuation bar 30 are not obstructed by the tabs 21 (which have returned to their initial positions) on their way of returning to their initial positions after the external force is removed. As illustrated in FIG. 1*b*, after the external force is removed, the lugs 31 are pulled backward by the biasing force from the resilient lever 34 and move along path "B" which is not obstructed by the tabs 21 which have dropped to their initial positions from the lugs 31 along the path "A".

The engagement between the lugs 31 and the tabs 21 are illustrated more clearly in perspective views 2*a*–2*d*, which show the actuation mechanism according to the present invention in various operational stages.

Figure 2A:
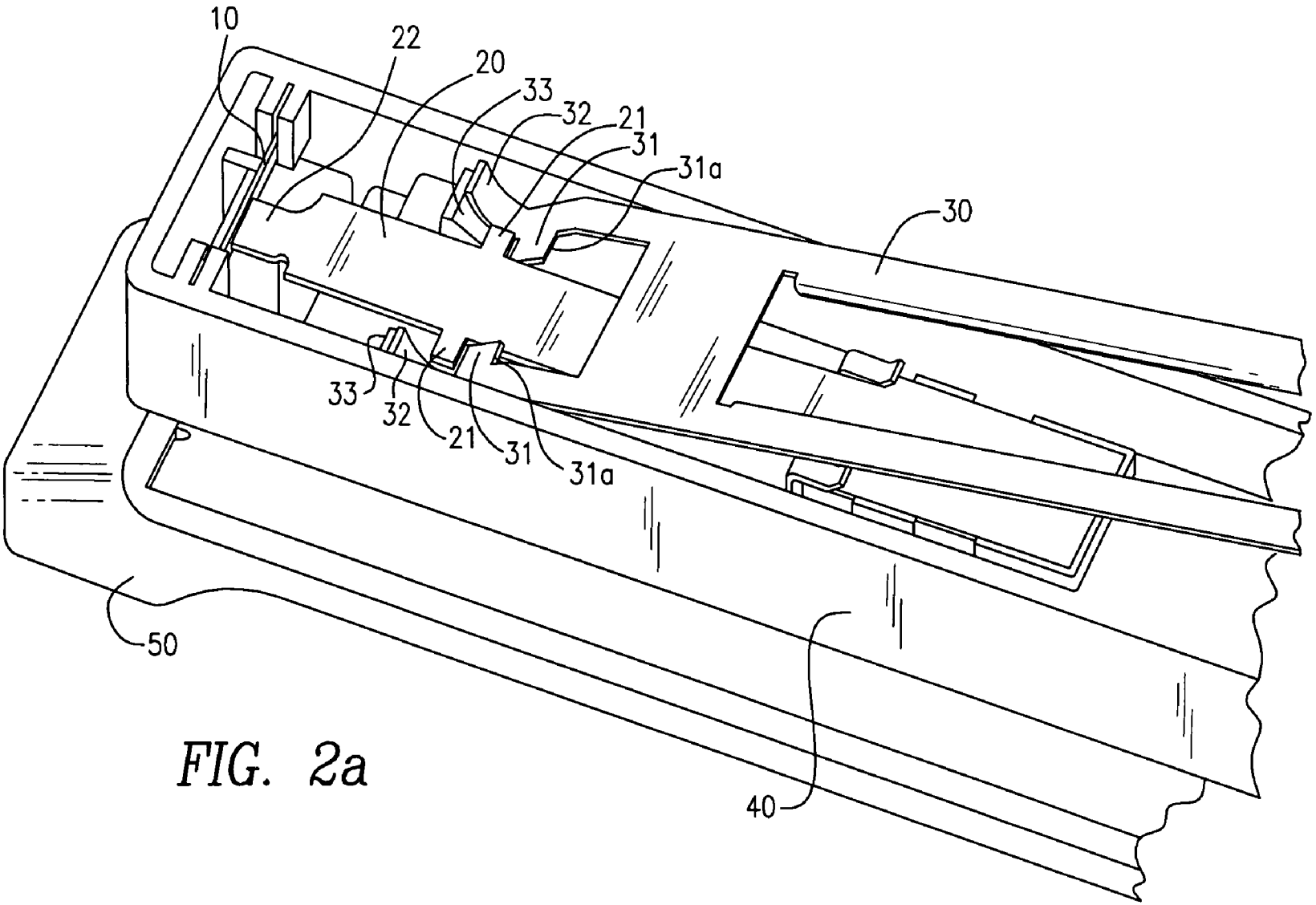
FIG. 2*a*–2*d* are partial perspective views showing the actuation mechanism of the stapler of FIG. 1 at various operational stages.

FIG. 2*a* shows the actuation mechanism in a position before or after a stapling operation, in which the actuation bar 30 rests in its initial idle position because there is no external force applied on it. The lugs 31 on the actuation bar 30 are not engaged with the tabs 21 of the leaf spring 20. The striking plate 10 rests in the initial position, and the leaf spring 20 is in the lower position.

Figure 2B:
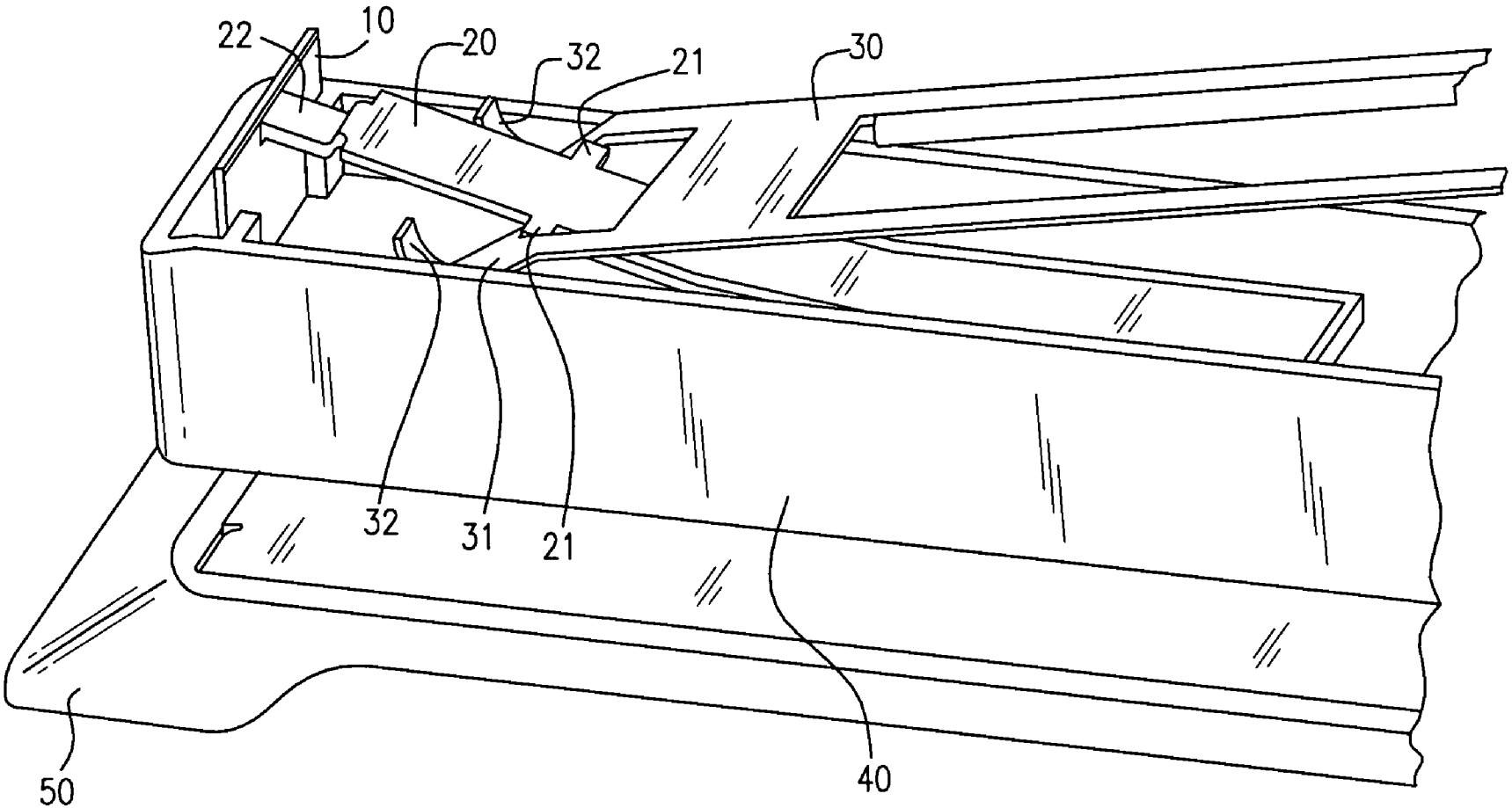
Figure 2C:
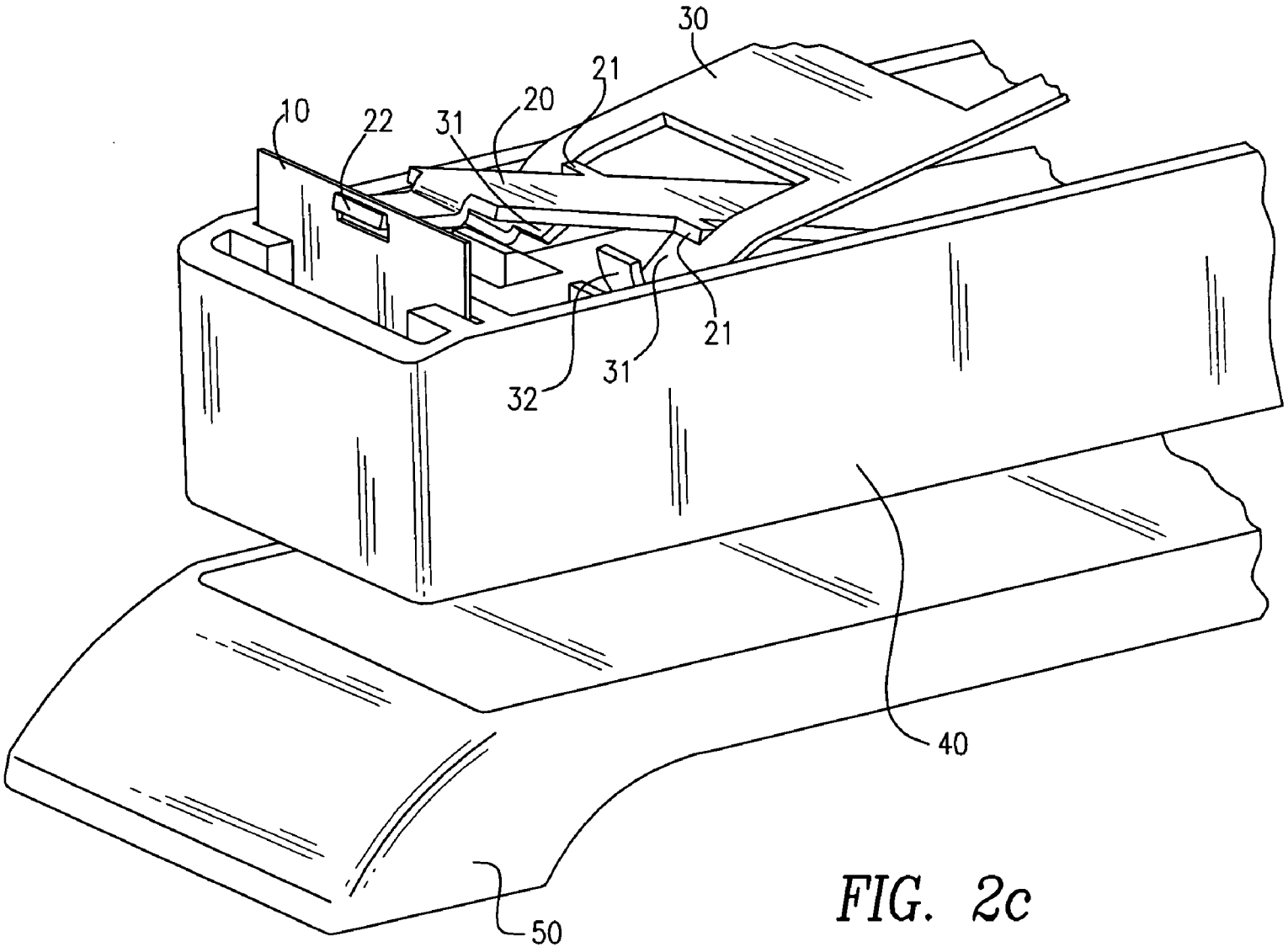
Figure 2D:
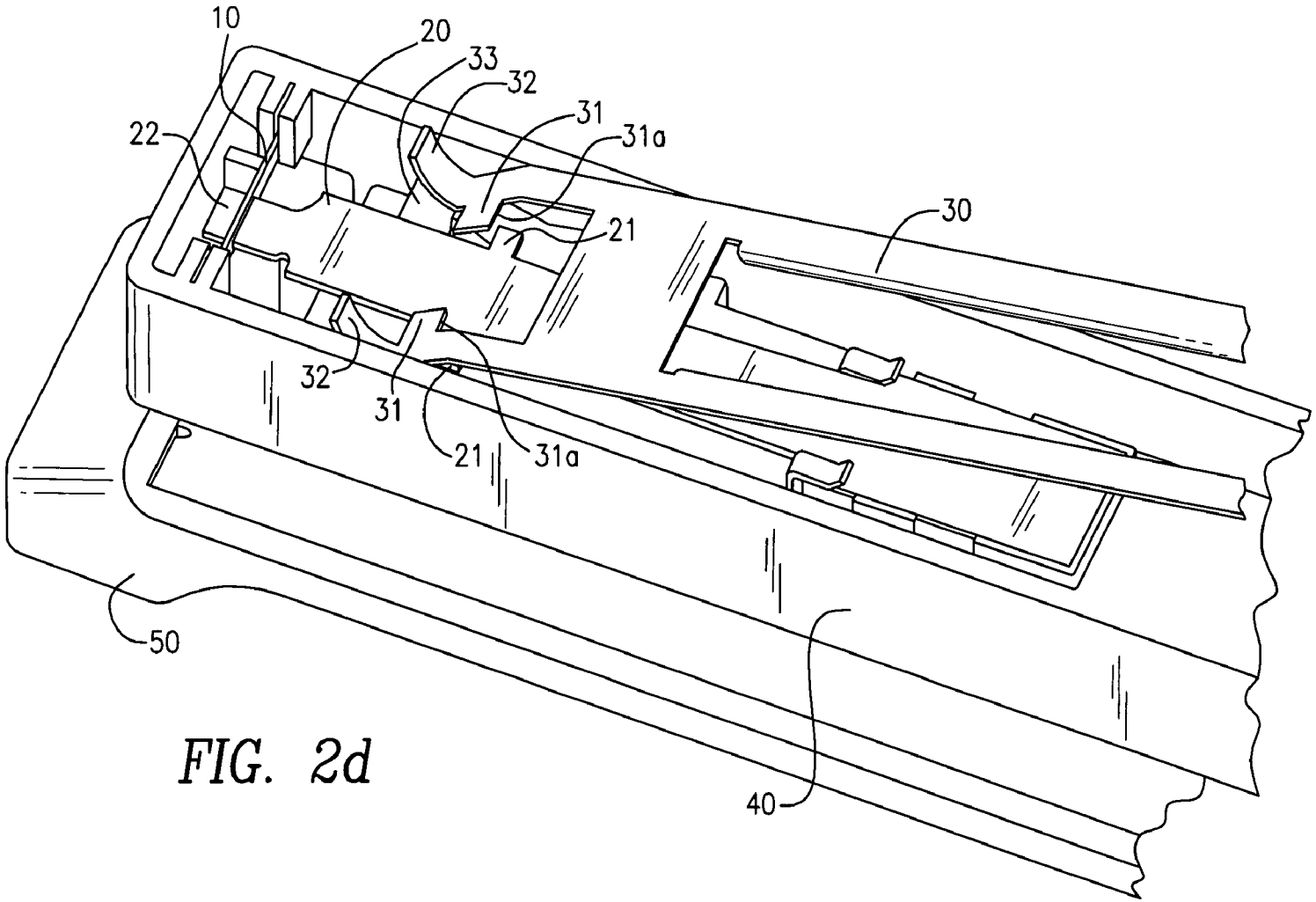

During the loading stage of the stapling operation, when the front end 32 of the actuation bar 30 is pushed forward by an external force, the lugs 31 come into engagement with the tabs 31 and push the tabs 21 upward when the front end 32 moves upward along the ramp 33, until the leaf spring 20 reaches the upper position where the striking plate 10 is lifted to the release position, as shown in FIGS. 2*b* and 2*c* in different angels of view. In this stage, the tabs 21 slide backward along the upper surface of the lugs 31 toward the back edges 31*a* of the lugs 31.

After the leaf spring 20 reaches the upper position and the striking plate 10 reaches the release position as shown in FIGS. 2*b* and 2*c*, when the L-shaped front end 32 further moves upwards along the ramp 33, the tabs 21 of the leaf spring 10 drops from the back edges 31*a* of the lugs 31 to disengage the leaf spring 10 from the actuation bar 30. Under the biasing force built in the leaf spring 20 during the loading stage, the leaf spring 20 snaps back to the lower position, and at the same time powerfully drives the striking plate 10 back to the initial position for stapling the work piece 70, as shown in FIG. 3*d*.

After the stapling operation is finished, the external force is removed from the actuation bar 30. Under the biasing force from the resilient lever 34 (see FIG. 1*a*), the actuation bar 30 returns to its initial position, as shown in FIG. 2*a*, and ready for a next stapling operation.

Although the above has described several preferred embodiments, it is appreciated that numerous adaptations, changes, variations and modifications are possible to a person skilled in the art without departing the spirit of the present invention. For example, the flat shaped tabs 21 may be implemented as a pair of laterally protruding rods mounted on the leaf spring 20. The resilient lever 34 can be replaced by any proper biasing mechanism for returning the actuation bar 30 toward its initial position. For example, the actuation bar 30 can also be a leaf spring with the back end 35 connected to the cover 60. Therefore, the scope of the present invention is solely intended to be defined by the accompanying claims.

What is claimed is:

1. A stapler comprising:

a striking plate for dispensing a staple from a staple magazine;

a leaf spring engaged with said striking plate for driving said striking plate; and an actuator for lifting said leaf spring, in a plane, from a first position to a second position whereby said leaf spring lifts said striking plate from an initial position to a release position, wherein said leaf spring is adapted to slide, in said plane, on said actuator while being lifted by said actuator, until said leaf spring is lifted to said second position in which said leaf spring is released from said actuator to drive said striking plate from said release position towards said initial position; and wherein said staple magazine comprises a guiding ramp adapted for said actuator to lift said leaf spring, in said plane, from said first position to said second position by means of having at least one contact point formed on one end of said actuator sliding on said guiding ramp.

2. The stapler of claim 1, wherein said actuator comprises a first end portion adapted to move upwards when a force is applied to said actuator, whereby lifting said leaf spring.

3. The stapler of claim 2, wherein said first end portion comprises a raising portion adapted to lift said leaf spring when said force is applied to said actuator.

4. The stapler of claim 3, wherein said first end portion further comprises a front portion adapted to move on said guiding ramp when said force is applied to said actuator.

5. The stapler of claim 4, wherein said raising portion of said actuator is adapted to push up a tab provided on said leaf spring and therefore to lift said leaf spring when said force is applied to said actuator.

6. The stapler of claim 5, wherein said tab and said raising portion is configured such that when said leaf spring is lifted to said second position, said tab disengages itself from said raising portion so as to release said leaf spring from said actuator.

7. The stapler of claim 6, wherein said tab is adapted to slide on an upper surface of said raising portion when said front portion moves on said guiding ramp.

8. The stapler of claim 7, wherein said tab and said raising portion are configured such that when said front portion moves on said guiding ramp, said raising portion moves upwards and said tab slides backwards on said upper surface of said raising portion.

9. The stapler of claim 8, wherein said raising portion is a lug protruded laterally from said actuator, and said tab of said leaf spring is adapted to disengage itself from said lug after said tab slides to an edge of said lug.

10. The stapler of claim 2, wherein said actuator further comprises a biasing mechanism for returning said actuator to an initial position after said applied force is removed.

11. The stapler of claim 10, wherein said biasing mechanism is a resilient lever connecting a second end of said actuator to a body of said magazine.

12. The stapler of claim 11, wherein said actuator further comprises a second end portion, and said force is applied to said second end portion.

13. The stapler of claim 12, wherein said force is applied to said actuator by pressing on a cover of said stapler pivotally connected to said magazine.

14. The stapler of claim 13, further comprising a base plate pivotally connected to said magazine.

15. A stapler comprising:

a striking plate for dispensing a staple from a staple magazine;

a leaf spring engaged with said striking plate for driving said striking plate; and an actuator for lifting said leaf spring, in a plane, from a first position to a second position whereby said leaf spring lifts said striking plate from an initial position to a release position, wherein said leaf spring is adapted to slide, in said plane, on said actuator while being lifted by said actuator, until said leaf spring is lifted to said second position in which said leaf spring is released from said actuator to drive said striking plate from said release position towards said initial position;

wherein said actuator comprises a first end portion adapted to move upwards when a force is applied to said actuator, whereby lifting said leaf spring;

wherein said first end portion comprises a raising portion adapted to lift said leaf spring when said force is applied to said actuator;

wherein said first end portion further comprises a front portion adapted to move on a guiding ramp when said force is applied to said actuator; and wherein said guiding ramp is provided on said magazine.

16. A stapler comprising:

a striking plate for individually dispensing staples from a staple magazine;

a leaf spring adapted to drive said striking plate from an initial position to a release position when said leaf spring is being lifted, in a plane, from a lower position to an upper position, and adapted to drive said striking plate from said release position back to said initial position when said leaf spring returns from said upper position to said lower position; and an actuator adapted to lift said leaf spring from said lower position to said upper position;

wherein said leaf spring is adapted to slide, in said plane, on said actuator while being lifted by said actuator until said leaf spring is lifted to said upper position in which said leaf spring is released from said actuator; and wherein said staple magazine comprises a guiding ramp adapted for said actuator to lift said leaf spring, in said plane, from said first position to said second position by means of having at least one contact point formed on one end of said actuator sliding on said guiding ramp.

17. The stapler of claim 16, wherein said actuator comprises a lateral lug for engaging with a tab provided on said leaf spring so as to lift said leaf spring when a force is applied to said actuator.

18. The stapler of claim 17, wherein said actuator further comprises a front end movable on said guiding ramp when said force is applied.

19. The stapler of claim 18, wherein said tab and said lateral lug are configured such that said tab disengages itself from said lug when said leaf spring reaches said upper position.

20. The stapler of claim 19, wherein said tab is adapted to slide on an upper surface of said lateral lug when said front end moves on said guiding ramp.

21. The stapler of claim 20, wherein said actuator is connected to said magazine through a resilient lever so as to return to its initial position when said applied force is removed.

22. An actuation mechanism for driving a striking plate in a spring actuated stapler, comprising:

a leaf spring engaged with said striking plate so as to drive said striking plate between an initial position and a release position; and an actuator for lifting said leaf spring, in a plane, from a lower position against a biasing force from said leaf spring to an upper position so that said leaf spring drives said striking plate from said initial position to said release position, wherein said leaf spring is adapted to slide, in said plane, on said actuator while being lifted by said actuator, until said leaf spring is lifted to said upper position in which said leaf spring is released from said actuator so as to return to said lower position, whereby driving said striking plate from said release position to said initial position; and wherein said staple magazine comprises a guiding ramp adapted for said actuator to lift said leaf spring, in said plane, from said first position to said second position by means of having at least one contact point formed on one end of said actuator sliding on said guiding ramp.

23. The actuation mechanism of claim 22, wherein said actuator comprises a laterally protruding lug adapted to push upwards a tab provided on said leaf spring so as to lift said leaf spring when an external force is applied to said actuator.

24. The actuation mechanism of claim 23, wherein said tab is adapted to disengage itself from said lug when said leaf spring reaches said upper position so as to release said leaf spring from said actuator.

25. The actuation mechanism of claim 24, wherein said actuator further comprises a front end portion adapted to move on a guiding ramp when said external force is applied to said actuator.

26. The actuation mechanism of claim 25, wherein said tab of said leaf spring is adapted to slide on an upper surface of said lug when said front end portion moves on said guiding ramp.

27. The actuation mechanism of claim 26, wherein said tab and lug are configured such that said tab disengages itself from said lug when said tab arrives an edge of said lug so as to release said leaf spring from said actuator.

28. The actuation mechanism of claim 27, wherein said actuator is connected to a body of a staple magazine through a resilient lever so as to return to an initial position when said external force applied to said actuator is released.

* * * * *